US008272895B2

(12) United States Patent
Park

(10) Patent No.: US 8,272,895 B2
(45) Date of Patent: Sep. 25, 2012

(54) SEALED ELECTRICAL CONNECTOR

(75) Inventor: Joo Hyun Park, Osan-si (KR)

(73) Assignee: FCI Automotive Holding, Guyancourt (FR)

( * ) Notice: Subject to any disclaimer, the term of this patent is extended or adjusted under 35 U.S.C. 154(b) by 0 days.

(21) Appl. No.: 12/998,597

(22) PCT Filed: Nov. 9, 2009

(86) PCT No.: PCT/IB2009/056009

§ 371 (c)(1),
(2), (4) Date: May 6, 2011

(87) PCT Pub. No.: WO2010/052691

PCT Pub. Date: May 14, 2010

(65) Prior Publication Data

US 2012/0015537 A1 Jan. 19, 2012

(30) Foreign Application Priority Data

Nov. 7, 2008 (WO) ..... PCT/IB2008/055639

(51) Int. Cl.
*H01R 13/40* (2006.01)

(52) U.S. Cl. ..... 439/587

(58) Field of Classification Search ..... 439/587, 439/148, 936, 588, 274, 275, 744, 598, 599, 439/589

See application file for complete search history.

(56) References Cited

U.S. PATENT DOCUMENTS

| | | | | |
|---|---|---|---|---|
| 5,348,498 | A * | 9/1994 | Morello et al. | 439/877 |
| 6,190,203 | B1 * | 2/2001 | Murakami et al. | 439/587 |
| 6,814,632 | B1 * | 11/2004 | Peterson | 439/877 |
| 7,114,991 | B2 * | 10/2006 | Shiga et al. | 439/587 |
| 7,448,908 | B2 * | 11/2008 | Iwahori et al. | 439/587 |
| 7,922,530 | B2 * | 4/2011 | Chazottes et al. | 439/587 |
| 2007/0025677 | A1 | 2/2007 | Harrison et al. | 385/138 |
| 2008/0280497 | A1 | 11/2008 | Casses et al. | 439/660 |
| 2009/0215298 | A1 * | 8/2009 | Chazottes et al. | 439/275 |
| 2011/0086544 | A1 * | 4/2011 | Yoshioka et al. | 439/587 |

FOREIGN PATENT DOCUMENTS

JP 07-106015 4/1995

* cited by examiner

*Primary Examiner* — Tulsidas C Patel
*Assistant Examiner* — Phuonchig Nguyen
(74) *Attorney, Agent, or Firm* — Harrington & Smith

(57) ABSTRACT

A sealed electrical connector includes a housing having a terminal-fixing portion, a mating portion for connecting to a counterpart connector and a partition wall therebetween. Contact terminals are fixed into a terminal holder with contact portions protruding out of the terminal holder. The terminal holder is disposed in the terminal-fixing portion. A grommet is placed between the terminal holder and the partition wall. The contact portions extend to the mating portion through the partition wall and the grommet. Molten resin is injected into the terminal holder and fix and seal the contact terminals in the terminal holder. The grommet prevents the resin from leaking into the mating portion through the partition wall. Each contact terminal has a support bracket fixed thereon which supports the terminal in the terminal holder before resin injection. The support bracket allows contact terminals of difference dimension to be fitted and sealed in the housing.

9 Claims, 5 Drawing Sheets

SEALED ELECTRICAL CONNECTOR

TECHNICAL FIELD

The present invention relates to an electrical connector. In particular, it relates to an electrical connector with contact terminals sealed to connector housing for use in motorized vehicle applications.

BACKGROUND

In certain applications such as in a motorized vehicle, electrical connectors such as cable connectors are usually required to have the contact terminals with cable-crimped portion sealed in the connector housing to prevent liquid contents from penetrating into the housing and erode the cable and/or the crimped portion. Sealing is typically made by resins which can be injected into connector housing in a molten state, and when cured and hardened, the resins seals the cable and the crimped terminal portion in the housing.

As there are holes formed on the housing through which a contact portion of contact terminals extend out of the housing for mating with counterpart connectors, presently available sealing process encounters problems of resin leaking through these holes. Leaked resin may form resin residues onto the contact portion of the contact terminals, which causes poor electrical contacts to counterpart connectors and should be avoided. On the other hand, these holes can not be too close to the external dimension of contact terminals otherwise the force requires to insert the contact terminals through the holes are increased.

It is therefore a need to provide an electrical connector which can allow contact terminals to pass through the housing holes freely during the assembly process and in the meantime, the contact terminals can be effectively sealed in the connector housing with reduced leaking possibilities.

SUMMARY OF INVENTION

The present invention relates to a sealed electrical connector for use in a motorized vehicle. The connector has a housing having a terminal-fixing portion, a recess for receiving a counterpart connector and a partition wall therebetween. Contact terminals are fixed into a terminal holder with contact portions protruding out of the terminal holder. The terminal holder is inserted into the terminal-fixing portion of the housing and with the contact portions extending into the recess through the partition wall. A grommet is placed between the terminal holder and the partition wall. The grommet has holes through which the contact portions of the contact terminals pass. A sealing material such as epoxy resin is injected into the terminal holder and seals the contact terminals in the terminal holder. The grommet holes tightly hoop around the contact portions of contact terminals to prevent leaking of the epoxy resin into the recess. The contact portions inside the recess are free of epoxy resin leakage and are suitable for making electrical connections with the counterpart connector. A support bracket or sleeve is fixed to a contact terminal and the support bracket supports and positions the terminal in the terminal holder. The support bracket allows contact terminals of difference dimension to be fitted and sealed in the housing.

Other aspects and advantages of the present invention will become apparent from the following detailed description, taken in conjunction with the accompanying drawings, illustrating by way of example the inventive concept of the present invention.

BRIEF DESCRIPTION OF THE DRAWINGS

These and other aspects and advantages of the present invention will be described in detail with reference to the accompanying drawings, in which.

DETAILED DESCRIPTION OF THE PREFERRED EMBODIMENTS

Figure 1:
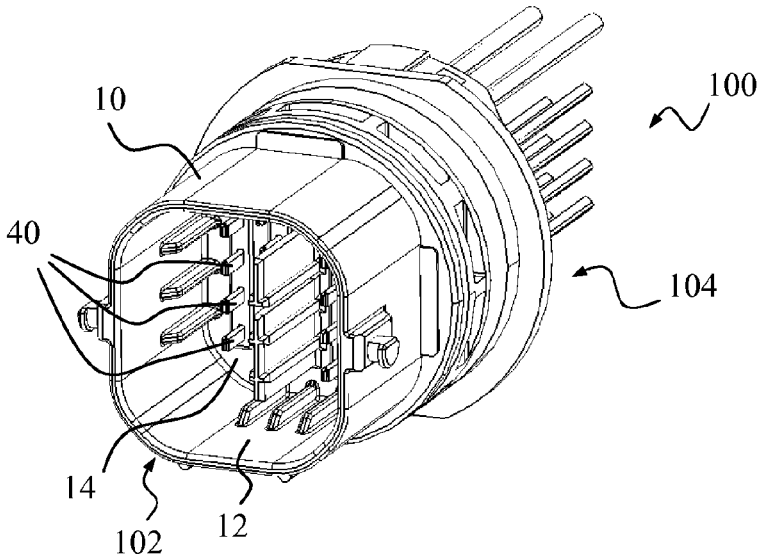
FIG. 1 is a perspective view showing an electrical connector according to one embodiment of the present invention.
Figure 2A:
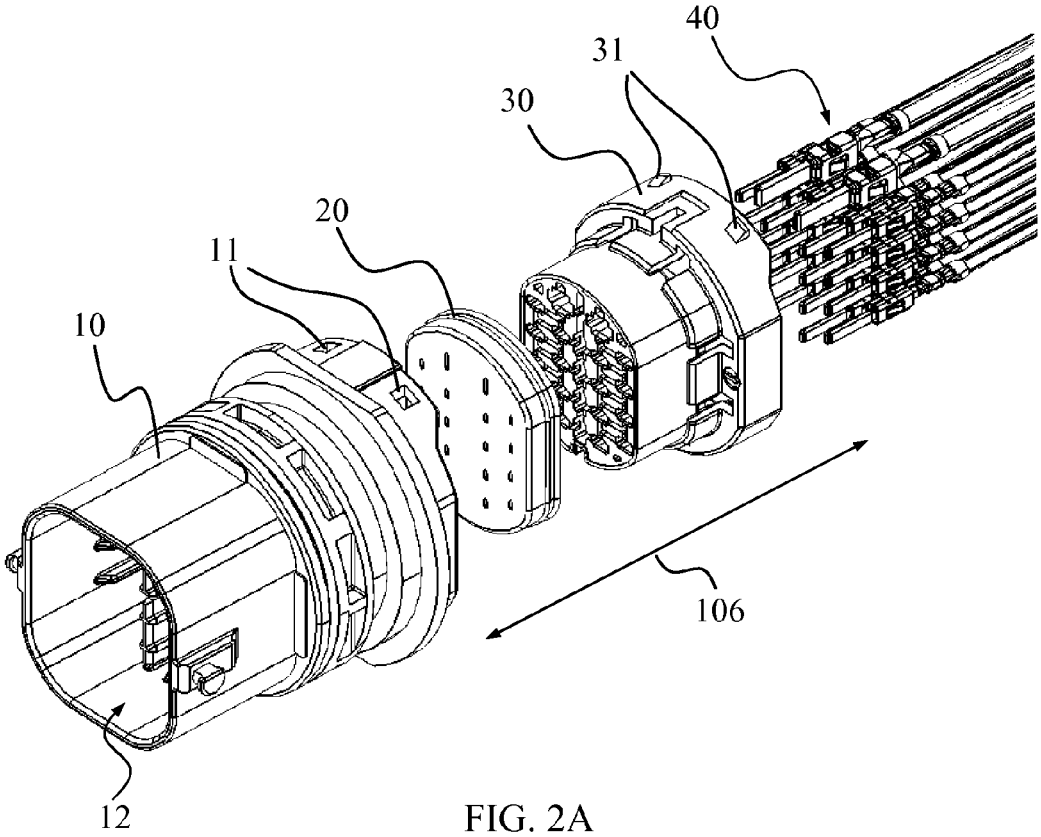
FIG. 2A is an exploded perspective front view of FIG. 1.
Figure 2B:
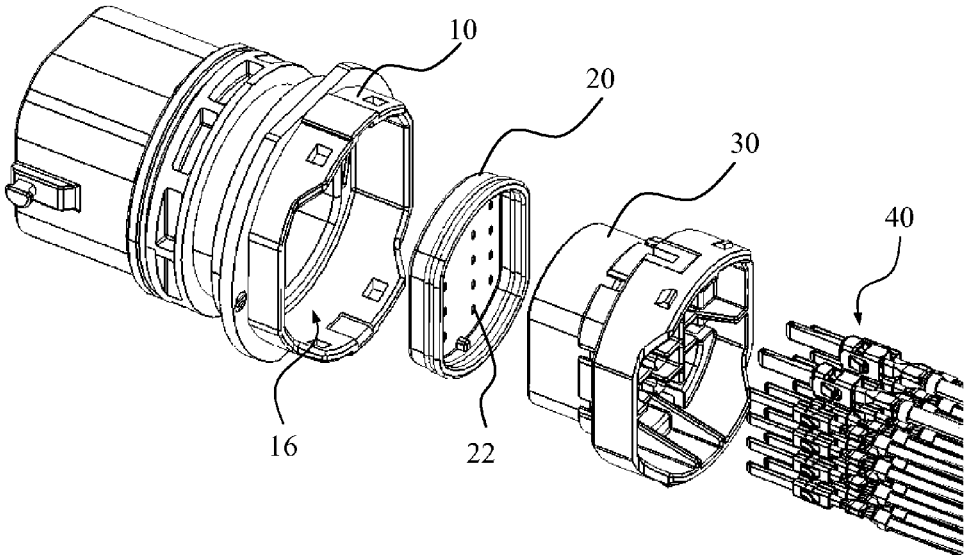
FIG. 2B is an exploded perspective back view of FIG. 1.
Figure 3:
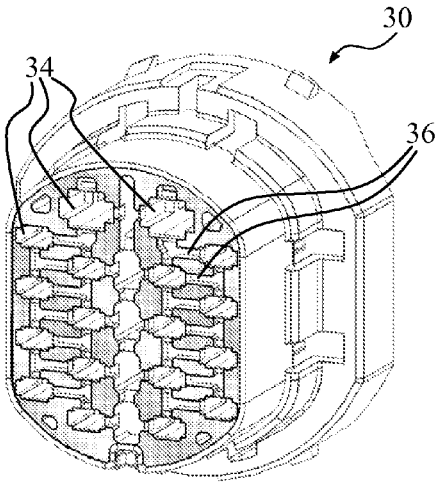
FIG. 3 is a perspective view showing a terminal holder of the connector of FIG. 1.
Figure 4:
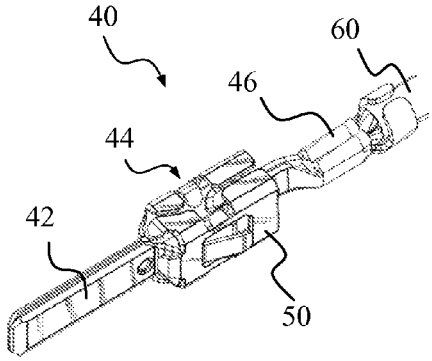
FIG. 4 is a perspective view showing a contact terminal of the connector of FIG. 1.

As shown in FIGS. 1, 2A and 2B, an electrical connector 100 according to an embodiment of the present invention has a housing 10 and a plurality of contact terminals 40 disposed in housing 10. Housing 10 has a mating portion in the form of a recess 12 opening to its front side 102, a terminal-fixing portion in the form of a cavity 16 opening to its back side 104, and a partition wall 14 between recess 12 and terminal-fixing portion 16. Recess 12 is to receive a counterpart connector (not shown) therein for establishing electrical connections. Disposed inside terminal-fixing portion 16 there is a terminal holder 30 into which contact terminals 40 are positioned and fixed, and a grommet 20 disposed between partition wall 14 and terminal holder 30.

As shown in FIGS. 3, 4, 5A and 5B, terminal holder 30 has a plurality of compartments 34. Each compartment 34 receives a contact terminal 40. Each contact terminal 40 has a front portion 42 for making electrical connection with a counterpart connector, a middle portion 44 for being supported by terminal holder 30 and a back portion 46 to which an electrical cable 60 is crimped. Middle portion 44 passes through a support bracket 50. Support bracket 50 is formed in a generally sleeve structure, with inner side gripping middle portion 44 of contact terminal 40. Outer side or external contour of support bracket 50 is dimensioned and shaped to be fitted into a corresponding compartment 34 of terminal holder 30. Contact terminals 40 are each positioned in terminal holder 30 by a respective support bracket 50, with front portions 42 extending though compartment 34. Compartment 34 is shaped and dimensioned to receive support bracket 50 in a tight-fit manner. Each compartment 34 has a front opening 32 to allow front portions 42 of contact terminals 40 to pass through freely.

Figure 6:
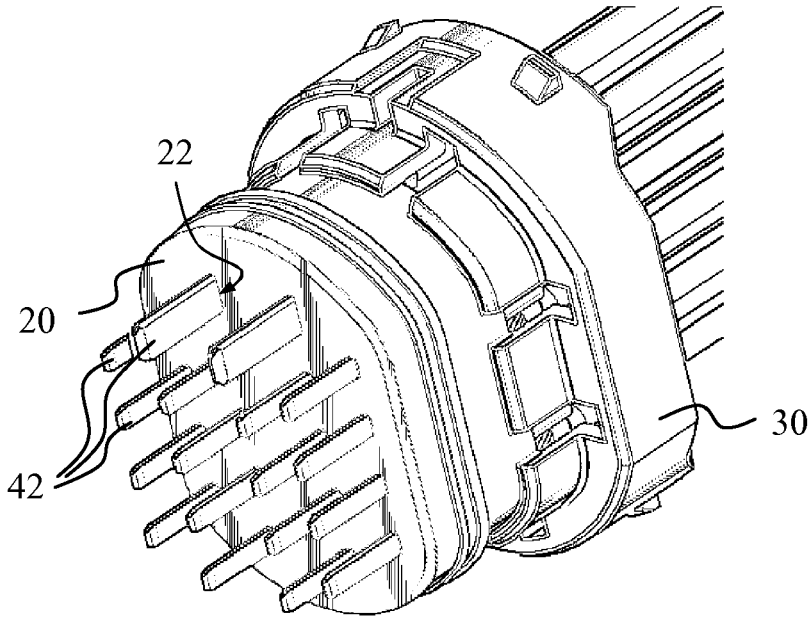
FIG. 6 is a perspective view showing a grommet capping the terminal holder shown in FIG. 5A.

Grommet 20 may be made of materials with some degree of resiliency, such as silicon rubber, and is of a generally cap-shaped structure. As shown in FIG. 6, when grommet 20 caps on terminal holder 30, front portions 42 of contact terminals 40 pass through apertures or holes 22 formed on grommet 20. Holes 22 are dimensioned to be about the same size as, or slightly smaller than, that of front portions 42 of contact terminals 40. Due to the resilient properties of grommet 20, holes 22 tightly hoops around the external periphery of front portions 42 of contact terminals 40. In this manner, there is substantially no gap between holes 22 and front portions 42 of contact terminals 40.

Engagement means may be provided to lock terminal holder 30 in housing 10. For example, as shown in FIG. 2A, engagement recess 11 are formed on housing 10, and engagement latches 31 are formed on terminal holder 30. When terminal holder 30 is inserted into terminal-fixing portion or cavity 16, engagement latches 31 fits into engagement recesses 11 to lock terminal holder 30 in housing 10. Engagement latches 31 and engagement recesses 11 may also provide additional effect to cause certain pressure to be added against grommet 20, along a direction parallel to axial direction 106 of connector 100. This pressure elastically compresses grommet 20 along axial direction 106, and cause holes 22 to more tightly hoop around portions 42 of contact terminals 40 to increase the sealing effect.

Figure 7A:
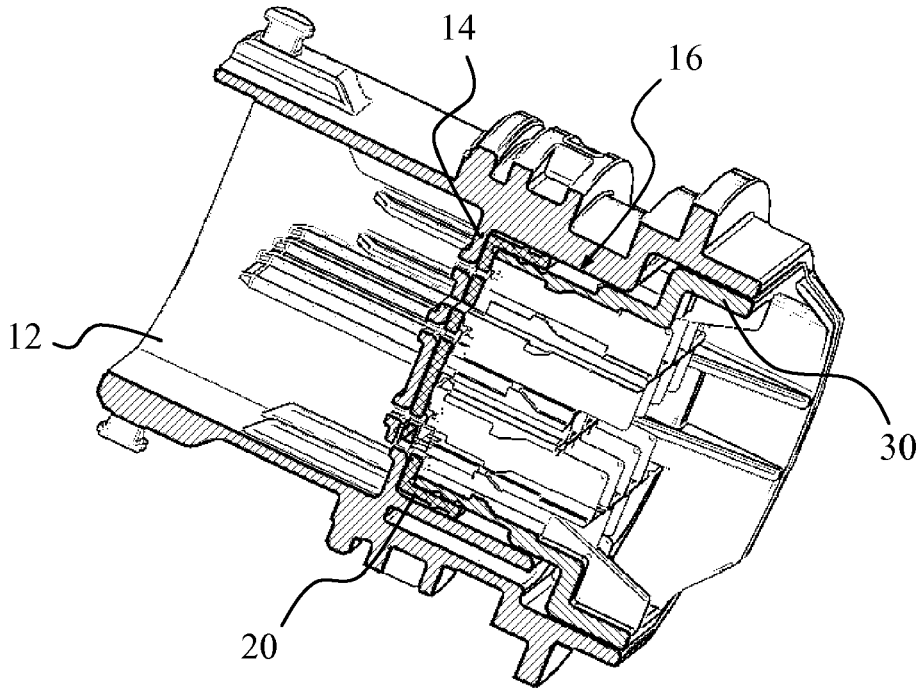
FIG. 7A is a cross sectional perspective view showing the electrical connector of FIG. 1 without the contact terminals.
Figure 7B:
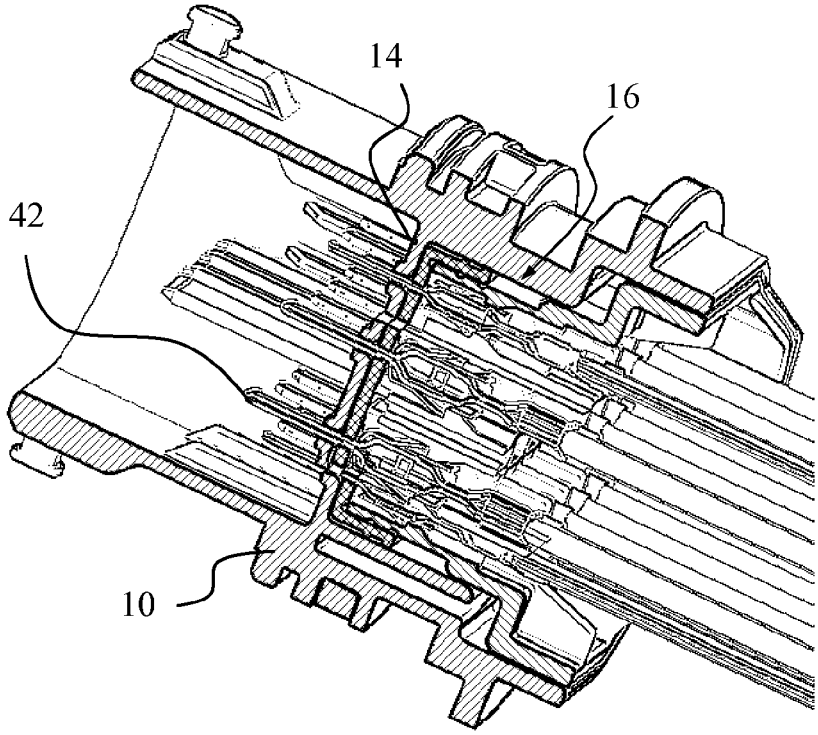
FIG. 7B is a cross sectional perspective view showing the electrical connector of FIG. 1 with the contact terminals assembled in the terminal holder and the housing.
Figure 7C:
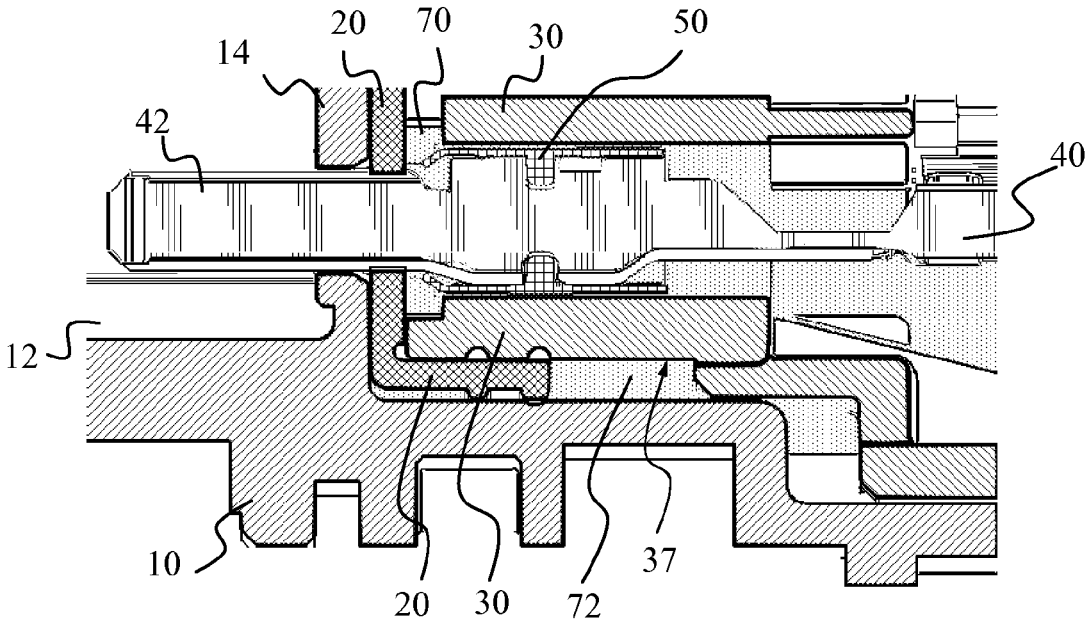
FIG. 7C is an enlarged partial cross sectional view of FIG. 7B.

In an assembling process, grommet 20 and terminal holder 30 are placed in terminal-fixing portion 16 of housing 10, with grommet 20 positioned between terminal holder 30 and partition wall 14, as shown in FIG. 7A. Thereafter, as shown in FIGS. 7B and 7C, contact terminals 40, each having a support bracket 50 fixed surrounding its center portion 44, are inserted into a corresponding compartment 34 of terminal holder 30. Support brackets 50 position contact terminals 40 in terminal holder 30, and front portions 42 of contact terminals 40 extend into recess 12 of housing 10.

A sealing material such as resin 70 is molten and injected into compartments 34 of terminal holder 30 from the back side 104. Resin 70 fills the cavity formed inside terminal holder 30, and the spaces between terminal holder 30 and terminal-fixing portion 16 of housing 10. Resin 70 also surrounds each contact terminal 40 at back portion 46 so as to seal the crimped portion of contact terminal 40 and cable 60. As holes 22 of grommet 20 closely fit to front portion 42 of each terminal 40, grommet 20 prevent resin from leaking through holes 22 into recess 12 of housing 10. When resin 70 is cured, contact terminals 40, terminal holder 30 and grommet 20 are all fixed and sealed in terminal-fixing portion 16 of housing 10, forming sealed electrical connector 100.

Terminal holder 30 not only serves to support and position contact terminals 40, but also occupies certain space inside terminal fixing portion 16. Accordingly, resin required to seal contact terminals 40 is reduced. This feature brings additional advantages of resin injection operation and cost saving.

Adjacent to the external front surface of compartments 34 there are formed of vent channels 36. During the operating stage of resin molding, liquid state resin may include air bubbles during and after curing/solidification. Air bubbles can be sucked out via vent channels 36 by providing a vacuum or negative pressure during the resin injection process.

Figure 5A:
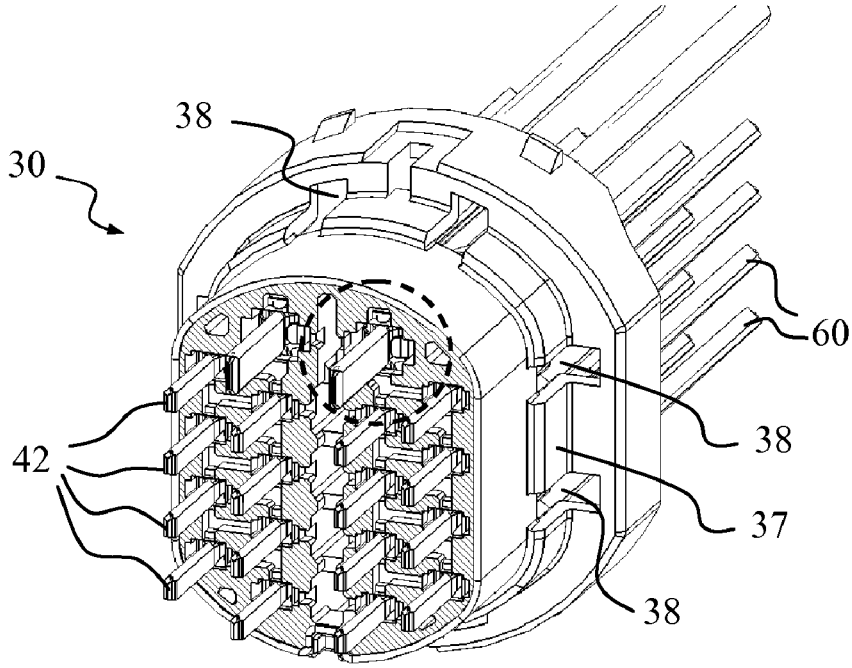
FIG. 5A is a perspective view showing the terminals positioned in the terminal holder of the connector of FIG. 1.
Figure 5B:
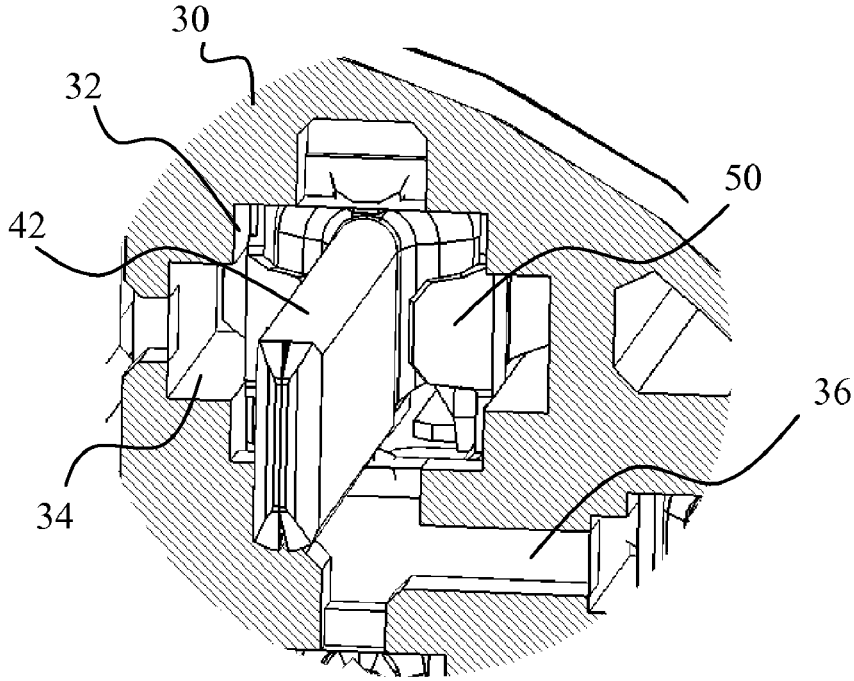
FIG. 5B is an enlarged partial perspective view of FIG. 5A.

As shown in FIGS. 5A and 7C, openings 38 may be provided on the side wall 37 of terminal holder 30. Openings 38 form channels between the external surface of side wall 37 and the inside cavity of terminal holder 30. In this embodiment, during the resin injection process, molten resin will also pass through openings 38 and form a sealing ring 72 surrounding the side wall and between the external side surface of terminal holder 30 and inner side surface of housing 10. When resin 70 is cured, sealing ring 72 tightly fills the space between the external side surface of terminal holder 30 and inner side surface of housing 10, and provides an additional sealing function.

Support bracket 50 may be formed as an integral part of contact terminal 40, or made as a separate piece and then removably attached to contact terminal 40. In the event that contact terminals 40 are required to have a different size, the inner size of support bracket can be changed so as to fix the contact terminals in the same manner. This feature allows broader selection of contact terminals having different dimensions and/or shapes, without modifying the shapes or dimensions of housing 10 or terminal holder 30. Space may be formed between support bracket and contact terminal, hence to allow the resin to flow easily during the injection process. Additionally, support brackets 50 occupy certain space inside terminal holder 30 which, also contributes to the reduced usage of resin.

Although embodiments of the present invention have been illustrated in conjunction with the accompanying drawings and described in the foregoing detailed description, it should be appreciated that the invention is not limited to the embodiments disclosed, and is capable of numerous rearrangements, modifications, alternatives and substitutions without departing from the spirit of the invention as set forth and recited by the following claims.

The invention claimed is:

1. An electrical connector comprising:

a housing having a mating portion for connecting to a counterpart connector, a terminal-fixing portion; and a partition wall between the mating portion and the terminal-fixing portion;

a terminal holder disposed in the terminal-fixing portion;

a grommet disposed between the partition wall and the terminal holder;

contact terminals extending through apertures provided on the partition wall and the grommet, each terminal having a support portion disposed in the terminal holder and a contact portion disposed in the mating portion, and a sealing material filled in the terminal holder to fix the contact terminals in the terminal holder.

2. The connector of claim 1, wherein each aperture of the grommet hoops around a periphery of a corresponding contact terminal to prevent the sealing material from passing through the aperture of the grommet.

3. The connector of claim 1, wherein the apertures of the partition are larger than an external dimension of the contact terminals to allow the contact terminals to freely pass through.

4. The connector of claim 1, wherein the terminal holder having a side wall and a plurality of openings formed on the side wall, the openings form channels between an external surface of the side wall and an inside cavity of the terminal holder to allow the sealing material to pass through.

5. The connector of claim 4, wherein the sealing material forms a sealing ring surrounding the side wall of the terminal holder.

6. The connector of claim 1, further comprising a plurality of brackets each supporting a corresponding contact terminal in the terminal holder.

7. The connector of claim 6, wherein the brackets are removably attached to the contact terminals.

8. The connector of claim 1, further comprising engagement means to lock the terminal holder in the housing.

9. The connector of claim 8, engagement means are positioned on the terminal holder and the housing to elastically compress the grommet along an axial direction of the connector.

* * * * *